United States Patent [19]

Kodaka

[11] 4,349,985

[45] Sep. 21, 1982

[54] STEAM PRESSURE-PROPELLED TOY

[76] Inventor: Tatsuya Kodaka, 25-6, 1-chome, Wakamiya, Nakano-ku, Tokyo, Japan

[21] Appl. No.: 160,356

[22] Filed: Jun. 17, 1980

[30] Foreign Application Priority Data

| | | | |
|---|---|---|---|
| Jul. 17, 1979 | [JP] | Japan | 54-90505 |
| Aug. 22, 1979 | [JP] | Japan | 54-105983 |
| Jan. 30, 1980 | [JP] | Japan | 55-8784 |
| Jan. 30, 1980 | [JP] | Japan | 55-8785 |

[51] Int. Cl.[3] ..... A63H 23/06

[52] U.S. Cl. ..... 46/95

[58] Field of Search ..... 46/95, 93, 91, 41

[56] References Cited

U.S. PATENT DOCUMENTS

| | | | |
|---|---|---|---|
| 1,993,670 | 3/1935 | Jones, Jr. et al. | 46/95 |
| 2,030,605 | 2/1936 | Moore | 46/41 X |
| 2,881,558 | 4/1959 | Bell | 46/95 |
| 4,045,907 | 9/1977 | Mumford | 46/93 |
| 4,073,086 | 2/1978 | Ogawa | 46/96 X |

FOREIGN PATENT DOCUMENTS

| | | | |
|---|---|---|---|
| 496230 | 9/1953 | Canada | 46/41 |
| 375616 | 6/1932 | United Kingdom | 46/95 |

*Primary Examiner*—Robert Peshock
*Assistant Examiner*—Mickey Yu
*Attorney, Agent, or Firm*—Jordan and Hamburg

[57] ABSTRACT

A steam pressure-propelled toy which floats on water comprising a boiler formed of a flat metallic hollow body from one end of which there project a pair of output pipes having open ends which are positioned below the water surface and a float body on which the boiler is mounted. Heating of the boiler is attained by a boiler heating mechanism such as an alcohol lamp or candle, and steam pressure ejected from the output pipes is utilized to provide a propulsive force. The open ends of the output pipes can change direction to advance or retreat, turn, or raise or lower the float body, and thus very interesting movements are attained.

12 Claims, 13 Drawing Figures

STEAM PRESSURE-PROPELLED TOY

BACKGROUND OF INVENTION

This invention relates to a ship-like toy which performs very interesting novel movements.

Heretofore, there has been proposed a ship-like toy in which a flat boiler is mounted within the ship body and a pipe extending from the boiler is projected below the water surface from the back of the ship body, and the boiler is heated for gasification to steam therewithin. By utilizing the repeated discharge of the steam and the fall of the internal pressure of the boiler there is obtained a propulsive force based on the discharged steam pressure. However, toys of this sort are so-called "ship toys" with the ship body or hull running on the water surface, and therefore are lacking in their ability to provide change of movement and to provide interesting shapes. For this reason there has been a demand for a ship-like toy which effects interesting movements and which assumes interesting shapes.

SUMMARY OF INVENTION

It is therefore an object of this invention to provide a steam pressure-propelled toy having high appeal.

It is another object of this invention to provide an assembly toy capable of being assembled and disassembled.

It is a further object of this invention to provide a scientific teaching toy in which the propulsion mechanism is formed of a transparent body that makes it possible to see through.

In this invention, in order to achieve the above objects, there is provided a float body which carries thereon a boiler and which is constructed in a special form which is not ship-like. Output pipes extending from the boiler are made transparent with open ends thereof and are capable of changing directions below the water surface.

The above and further objects and novel features of the invention will more fully appear from the following detailed description when the same is read in connection with the accompanying drawings. It is to be understood, however, that the drawings merely illustrate embodiments of the invention and are not intended to limit the scope of the invention.

DETAILED DESCRIPTION OF INVENTION

Figure 1:
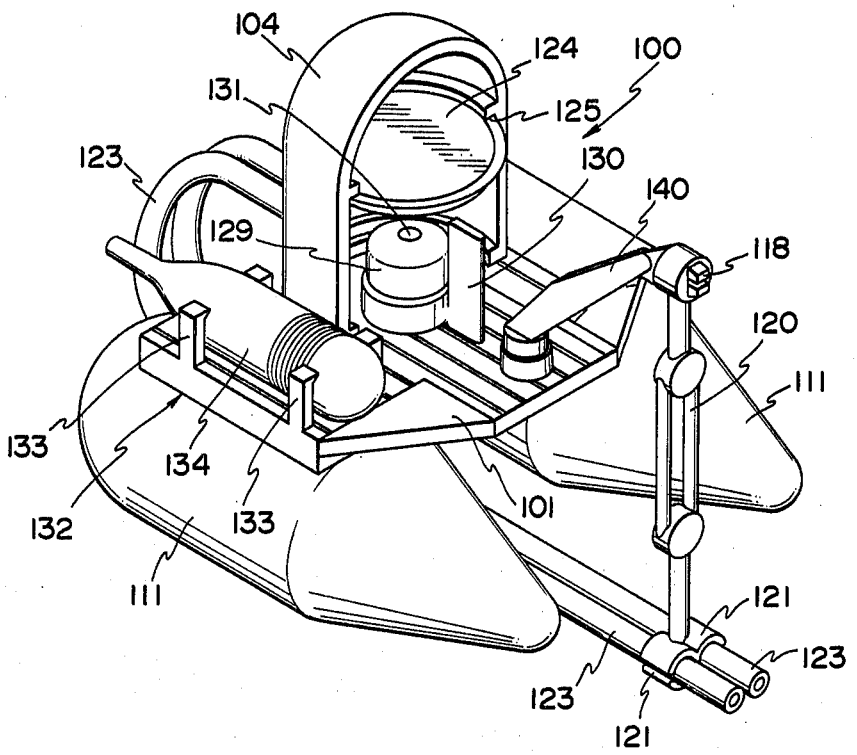
FIG. 1 is a perspective view of a steam pressure-propelled toy according to a first embodiment of the invention.
Figure 2:
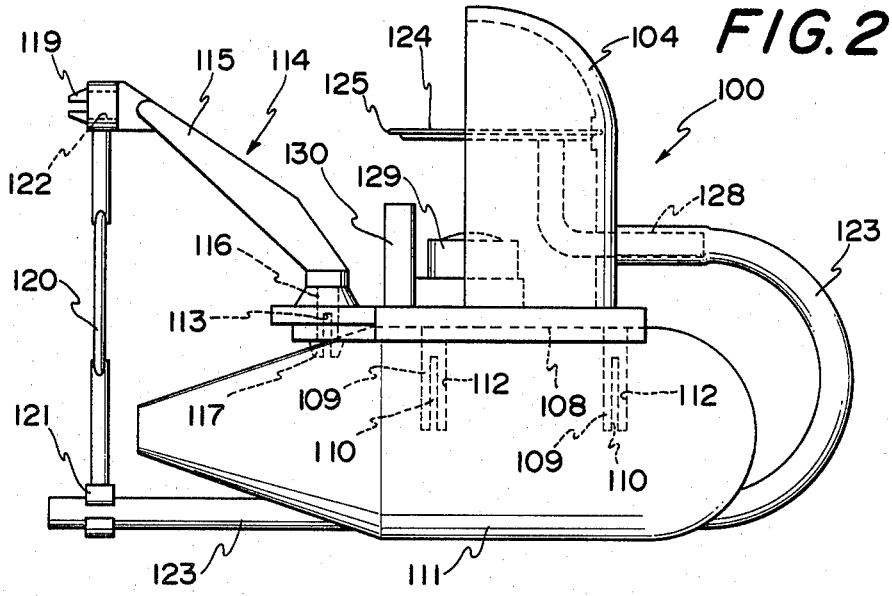
FIG. 2 is a side view thereof.
Figure 3:
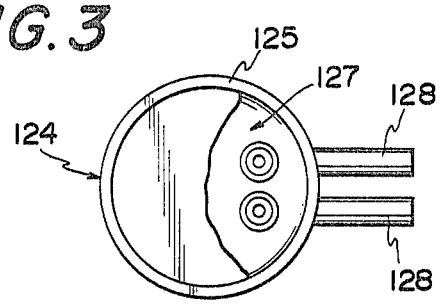
FIG. 3 is a partially cutaway plan view of a boiler section thereof.
Figure 4:
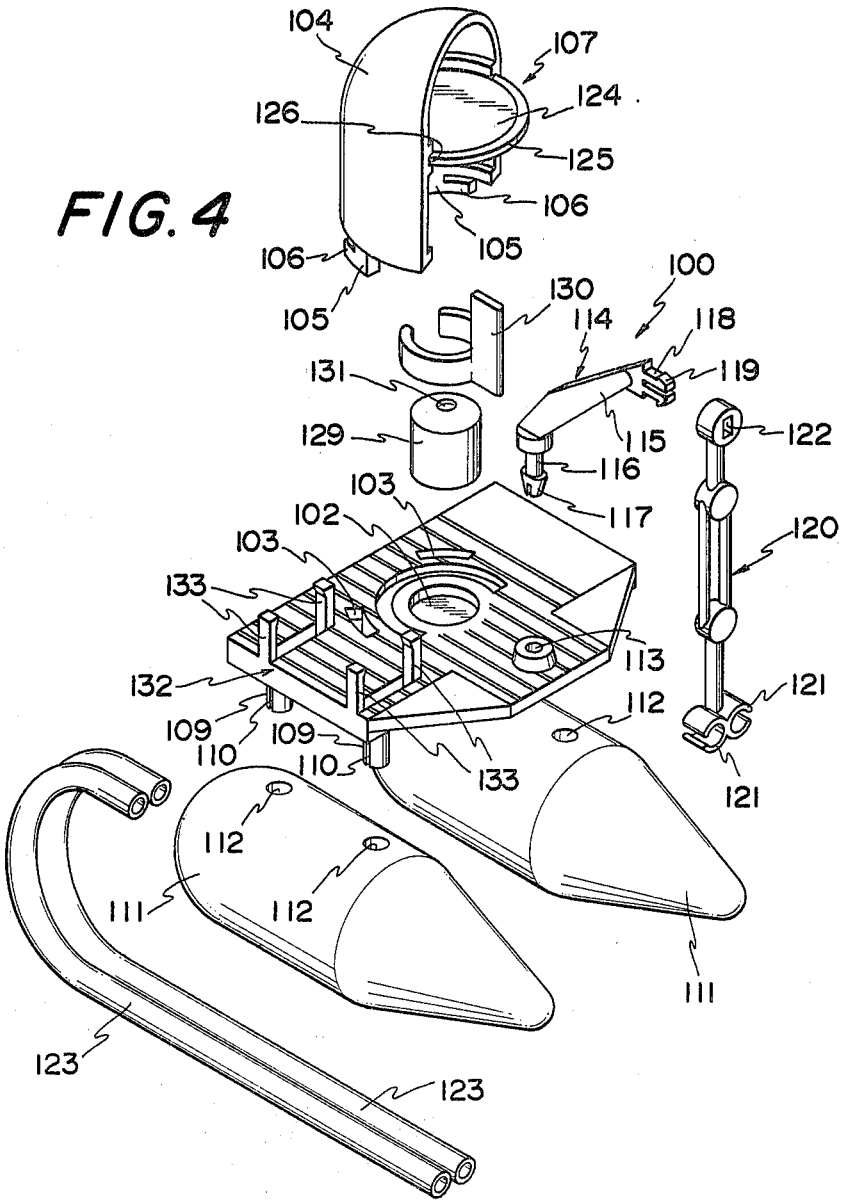
FIG. 4 is an exploded perspective view of the toy.

A first embodiment of a steam pressure-propelled toy 100 of this invention is now described with reference to FIGS. 1 through 4. The reference numeral 101 is a generally plate-like deck formed of a synthetic resin, which is provided nearly centrally in the upper surface thereof with a recess 102 in which is fitted the bottom part of an alcohol lamp 129, and further provided about the recess 102 with arcuate engaging holes 103, 103 in which are inserted hook ends 106, 106 of hook-like engaging legs 105, 105 projecting from the lower ends of a half cut bell-shaped windshield 104 which is formed of a heat-resisting resin. In this inserted position of the hook ends 106, 106, if an opening portion 107 of the windshield 104 is turned backwards of the deck 101, the hook ends 106, 106 are retained on the lower surface of the deck 101 and thus prevented from coming out whereby an integral construction is attained. In the lower surface on both sides of the deck 101 are formed slots 108, 108 having an arcuate section, and extending downwards from near the front and rear ends at the center of the slots 108, 108 are fitting shafts 109, 109 the tip ends of which each constitute a split pin-shaped engaging end 110, the shafts 109, 109 consisting of a hollow body of a synthetic resin or a non-communicating foamed resin such as polystyrene foam. The shafts 109, 109 are inserted in holes 112, 112 formed in the upper ends of two cannon ball-like float bodies 111, 111 which has a sufficient buoyancy, whereby the upper ends of the float bodies 111, 111 and the slots of arcuate section 108, 108 are brought into close contact with each other and thereby fixed integrally. Formed in the rear end of the deck 101 is an axial bore 113 in which is rotatably inserted a pivot shaft 116 which is integrally formed at the lower end of an arm portion 115 of a rudder member 114 with the arm portion 115 extending obliquely upwards. The end portion of the pivot shaft 116 constitutes a split pin-shaped engaging end 117 whereby the pivot shaft 116 is prevented from coming off the axial bore 113 and at the same time it comes into internal contact with an elastic pressure within the axial bore 113 and is thereby endowed with a suitable resistance to rotary movement. At the other end of the arm portion 115 of the rudder member 114 is formed a square shaft 118 having a split pin-shaped engaging end 119, over which is unpivotably fitted a square hole 122 which is formed at the upper end of a vertically extending connecting rod 120, the connecting rod 120 being provided at the lower end thereof with pipe holding ends 121, 121 which are positioned so as to be lower than the draft surface of the toy in question when assembled. The pipe holding ends 121, 121 are adapted to hold transparent flexible pipes 123, 123 made of polyethylene or vinyl resin in the vicinity of end portions of the pipes, the pipes 123, 123 being connected to output pipes 128, 128 of a boiler 124 as will be described hereinafter. The boiler 124 is composed of a flat disc-like thin, hollow metallic body and it has an edge portion 125 which is fitted and retained in a retaining groove 126 formed in an inner intermediate position of the windshield 104. Projecting from one end of the lower surface of the boiler 124 are two metallic output pipes 128, 128 which are welded so as to open into a hollow portion 127. The output pipes 128, 128 are conducted to the outside from through holes formed in the front wall of the windshield 104. An alcohol lamp is mounted by inserting a handle 130 from the outside so that a fire hole 131 is positioned under the boiler 124. Alternatively, the alcohol lamp may be replaced by a candlestick or the like. The reference numeral 132 designates a water injector mounting section provided on one side of the upper surface of the deck 101 and having upright holding columns 133 between which is fitted a squirt-like water injector 134.

In operation of the steam pressure-propelled toy of this invention constructed as above, the alcohol lamp 129 is ignited and then fitted in the recess 102 of the deck 101 to heat the lower surface of the boiler 124. Thereafter, the toy is floated on the water surface and water is injected from the open end of one transparent flexible pipe 123 by means of the water injector 134. By this initial operation the water reaches the hollow portion 127 of the boiler 124 through the medium of the output pipe 128 while it exhausts the air present in the boiler hollow portion 127 from the other transparent flexible pipe 123, and the water becomes gasified in contact with the heated wall of the boiler 124. By virtue of this gasification and the resulting sudden increase in volume, the steam goes through the output pipes 128, 128 and transparent flexible pipes 123, 123 and is ejected vigorously from the open ends together with the water which has entered the transparent flexible pipes 123, 123, resulting in that the hollow portion 127 is reduced in pressure, thus allowing water to enter again from the transparent flexible pipes 123, 123 and output pipes 128, 128, and the water thus entered reaches the hollow portion 127 of the heated boiler 124 and repeats the foregoing action. Thus, the volume of the steam ejected from the transparent flexible pipes 123, 123 is so large as compared with the volume of intake water that this difference creates a propulsive force of the ship and allows the latter to advance. Since the wall surface of the boiler 124 is heated and cooled repeatedly, its thermal expansion causes the plate body to be distorted and make a sound "pokon, pokon". To change the propelling direction of the toy, the rudder member 114 is pivoted; that is, the transparent flexible pipe 123 is bendable, so if the rudder member 114 is changed direction, the connecting rod 120 displaces itself while describing an arc locus about the pivot shaft 116 to change the holding direction for the transparent flexible pipe 123, so that the direction of steam ejection is changed to allow the ship to turn.

Thus, the steam pressure-propelled toy in the above-described embodiment can change the direction of steam ejection, so it has steerability and can stimulate interest. Besides, the state of action can be observed since the propulsion mechanism is transparent. The steam pressure-propelled toy 100 in this embodiment is further advantageous in that its structural interest is emphasized because it does not constitute the very shape of a ship but is basically similar thereto, and in that a highly stable floating toy is obtainable because the buoyancy is stably assured by a closed type float body. A still further advantage of the steam pressure-propelled toy according to this embodiment is that it can be offered as an assembly toy because it can be assembled by fitting together the components thereof.

Figure 5:
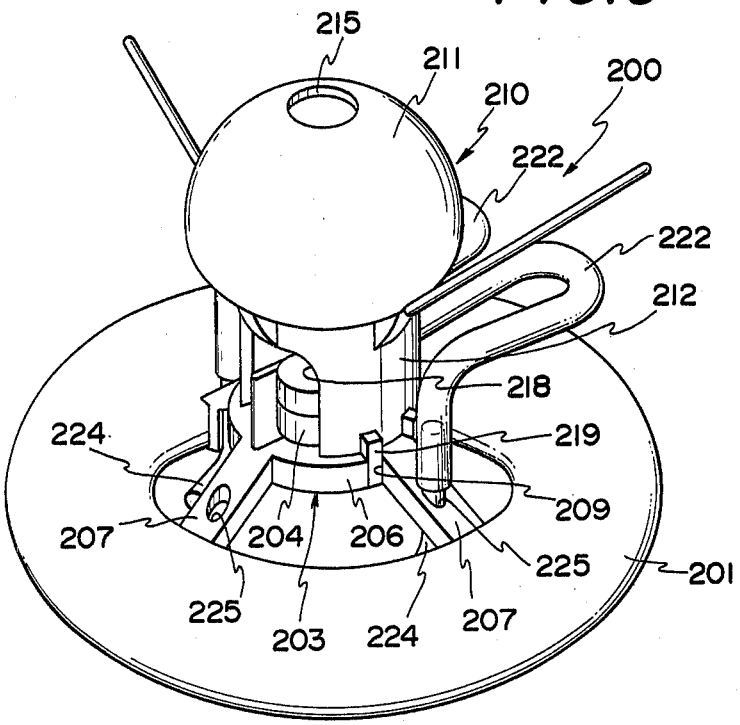
FIG. 5 is a perspective view of a steam pressure-propelled toy according to a second embodiment of the invention.
Figure 6:
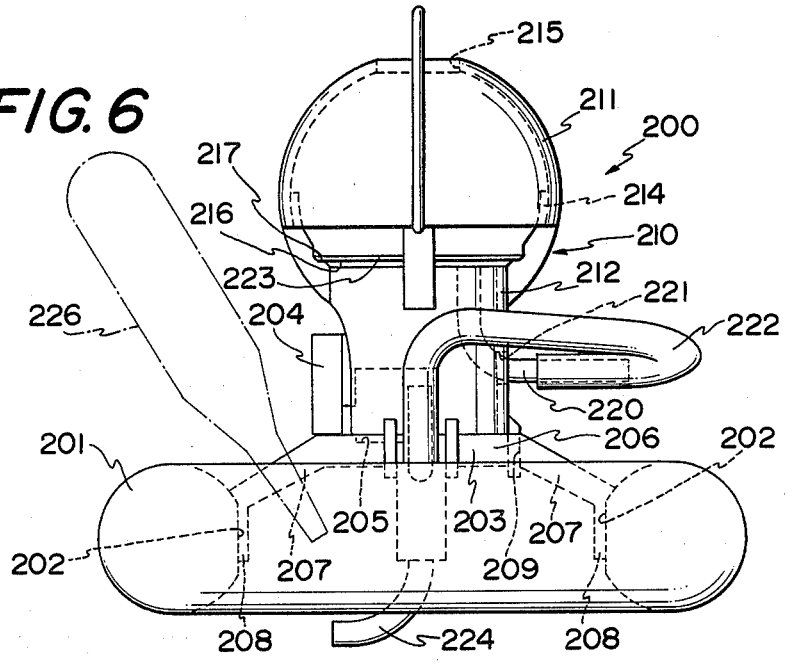
FIG. 6 is a side view thereof.
Figure 7:
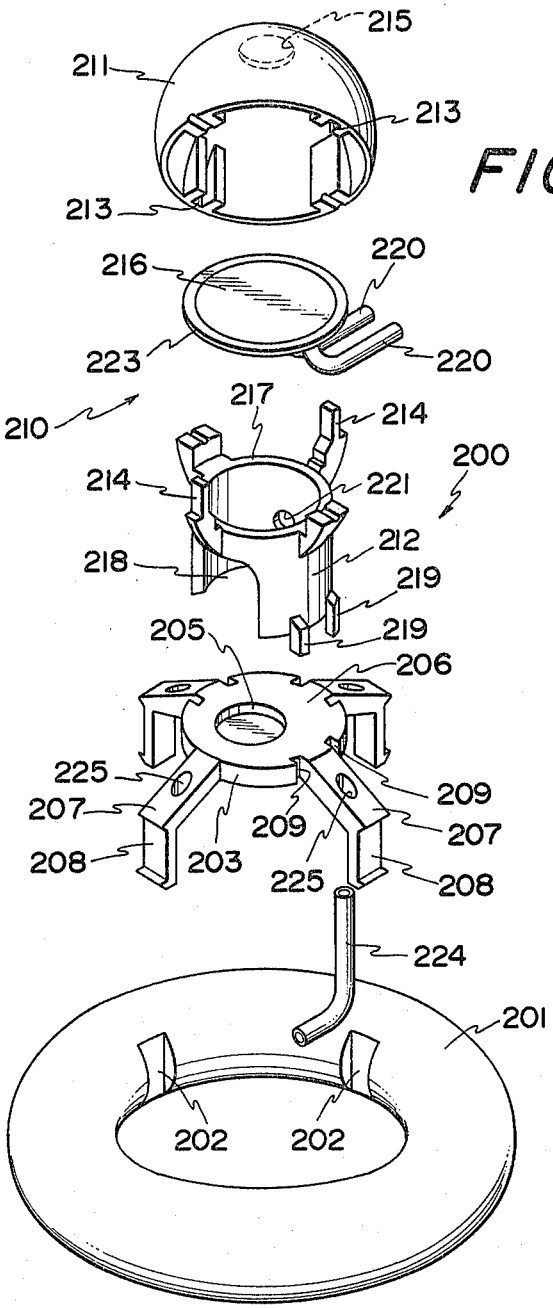
FIG. 7 is an exploded perspective view thereof.

Referring now to FIGS. 5 through 7, there is shown therein a steam pressure-propelled toy 200 according to a second embodiment of this invention. The reference numeral 201 is a doughnut-like float body in the inner peripheral surface of which are formed fitting grooves 202 at equal intervals so that a base 203 is fitted therein removably. The base 203 is composed of a base plate 206 in the upper surface of which is formed a concave portion 205 for mounting of a boiler heating mechanism such as an alcohol lamp 204, and leg portions 207 extending from the peripheral wall of the base plate 206 in corresponding relation to the fitting grooves 202 of the float body 201, with each leg portion 207 having a perpendicularly bent end to form a retaining port 208 for engagement with the fitting groove 202 of the float body 201. The numeral 210 designates a windshield consisting of bowl-like windshield cover 211 and a generally cylindrical windshield body 212, the windshield cover 211 having fitting grooves 213 formed in the inner surface thereof and the windshield body 212 having engaging pieces 214 formed in corresponding relation to the fitting grooves 213, both being constructed detachably. Formed at the top of the windshield cover 211 is a vent hole 215 to dissipate the heat of the boiler 216. On the other hand, the cylindrical upper end face of the windshield body 212 constitutes a mounting part 217 for the boiler 216, and in a suitably portion of the peripheral wall of the windshield body 212 is defined an opening 218 for taking in and out the alcohol lamp 204, and further at the lower end portion of the windshield body 212 are formed projections 219 adapted to fit in concave grooves 209 which are formed in the base 203. Disposed removably within the above-constructed windshield 210 is the boiler 216 as a disc-like hollow body made of a thin metallic plate. The peripheral edge portion of the boiler 216 forms a flange portion 223 for engagement with the boiler mounter part 217 of the windshield body 212, with a pair of output pipes 220, 220 projecting from a position near the periphery of the lower surface of the boiler 216. The tip end sides of the output pipes 220, 220 depending from the lower surface of the boiler 216 are bent in the horizontal direction, and the tip ends of the so-bent portions are extended outside through small holes 221, 221 formed in the wall surface of the windshield 210. To the extending ends of the output pipes 220, 220 are connected one ends of the transparent flexible pipes 222, 222, with the other ends of the pipes 222, 222 being connected to the upper ends of propellent pipes 224, 224 attached to the leg portions 207 of the base 203. The propellent pipes 224, 224 are pivotally inserted rotatably and removably with respect to through holes 225, 225 formed in the leg portions 207 so that the lower end sides of the propellent pipes 224, 224 are positioned below the draft surface of the float body 201, with the ends thereof being bent in the horizontal direction.

In operation of the steam pressure-propelled toy 200 constructed as above, the alcohol lamp 204 is ignited and placed on the concave portion 205 of the base 203 through the opening 218 of the windshield 210, then water is injected within the boiler 216 from one propellent pipe 224 by means of a water injector 226 which is mounted easily removably by utilization of the through hole 225 formed in the leg portion 207 as illustrated with the result that, by the same action as in the foregoing first embodiment, steam is ejected from the propellent pipe 224 and this steam pressure creates a propulsive force. The propellent pipes 224, 224 are rotatably attached to the leg portions 207, so by changing the direction thereof the float body 201 thus endowed with a propulsive force can undergo various movements such as a rectilinear back and forth movement, an arcuate movement, and the rotation of the float body 201. In addition, the propellent pipes 224, 224 are detachably attached to the leg portions 207, so by changing the position of insertion of the propellent pipes 224, 224 there can be imparted further changes to the foregoing varied movements of the float body 201.

Figure 8:
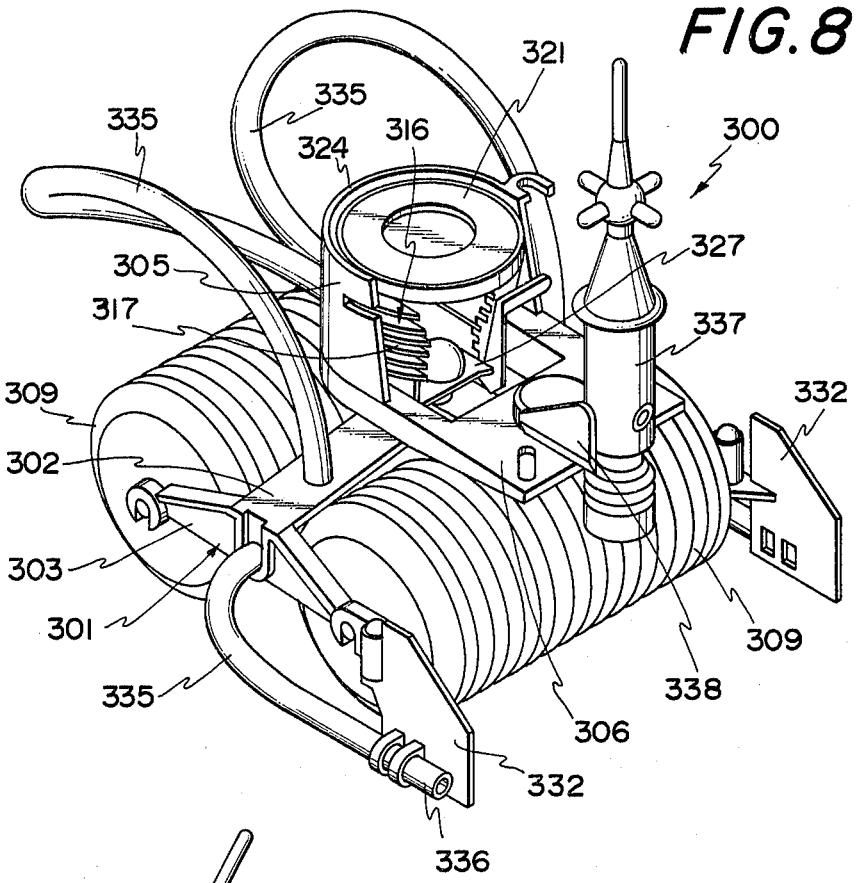
FIG. 8 is a perspective view of a steam pressure-propelled toy according to a third embodiment of the invention.
Figure 9:
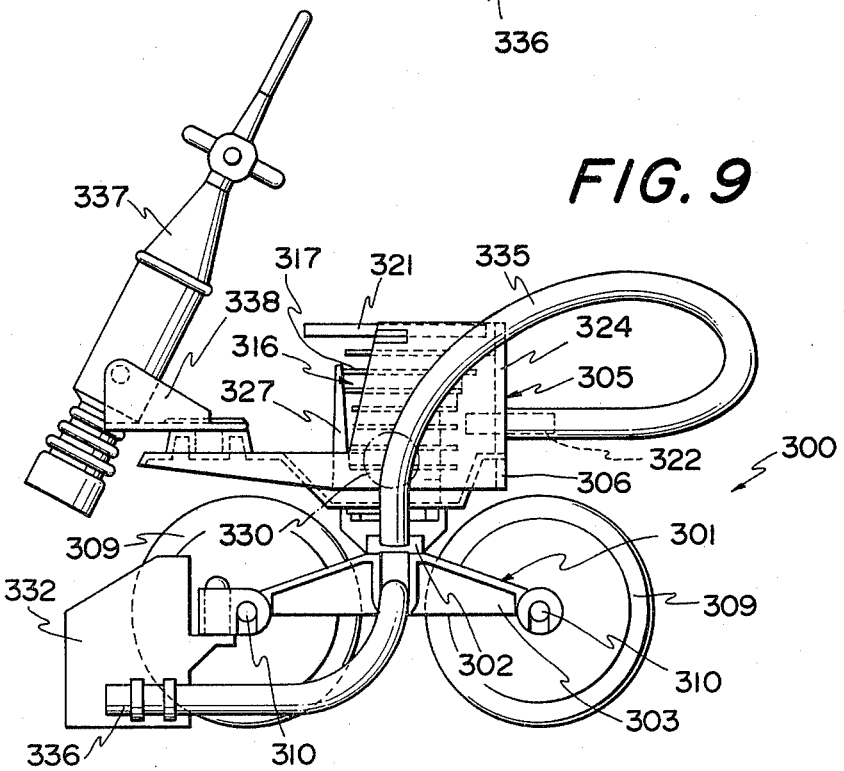
FIG. 9 is a side view thereof.
Figure 10:
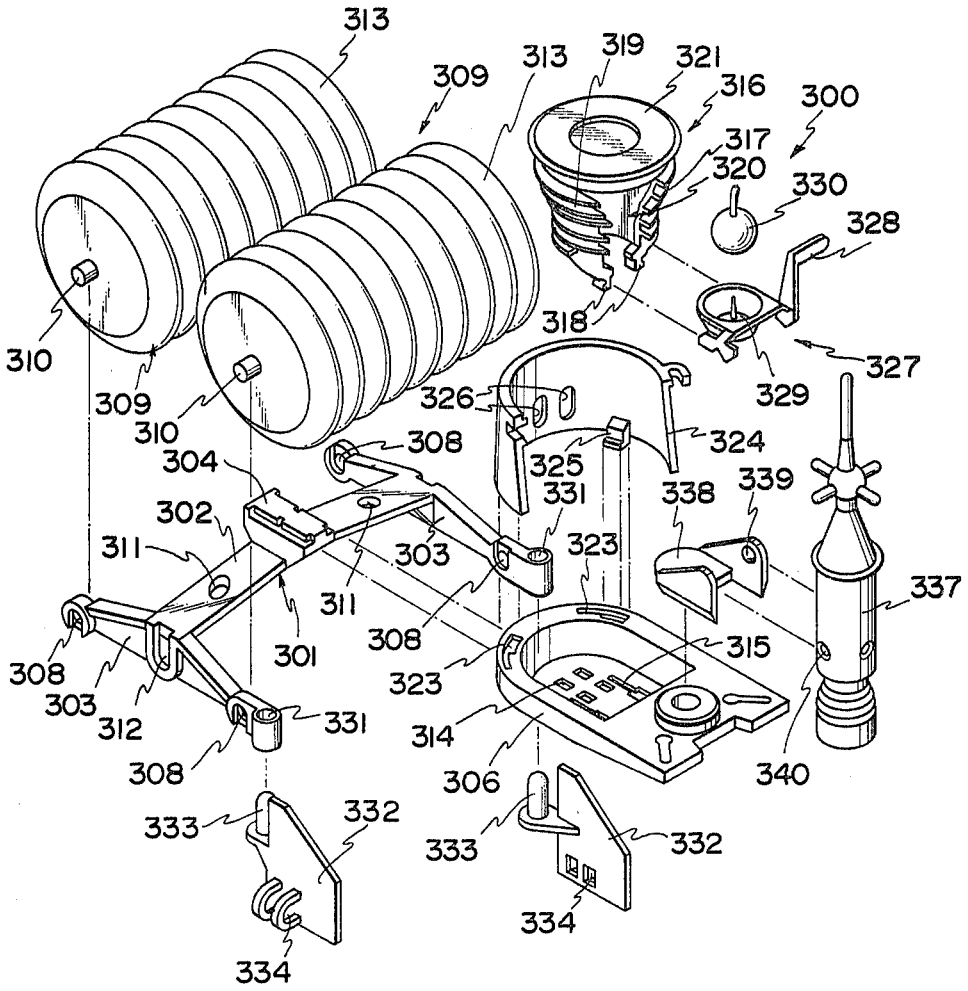
FIG. 10 is an exploded perspective view thereof.

A steam pressure-propelled toy 300 according to a third embodiment of this invention is now described with reference to FIGS. 8 through 10. The reference numeral 301 is a base member formed of a hard synthetic resin and consisting of a base rod 302 and supporting rods 303, 303 which extend in the horizontal direction at both ends of the base rod 302. On the central portion of the upper surface of the base rod 302 is formed a projection 304 over which is fitted a concave portion 307 formed in the central part of the lower surface of a bottom member 306 of a boiler chamber 305. At the ends of the supporting rods 303, 303 are formed two pairs of axial holes 308, 308, . . . in which are pivotably inserted and journalled projecting shafts 310, 310, . . . centrally mounted on each side end plates of roller-shaped hollow float tubes 309, 309. The numerals 311 and 312 designate intermediate holes for insertion therethrough a transparent flexible pipe 335 as will be described later in this text. In the circumferential direction of each float tube 309 are formed a multitude of ridges 313. In a concave step portion 314 of the bottom member 306 are formed engaging holes 315, 315 in which are fitted retaining projections 318, 318 formed at lower ends of a lower frame portion 317 of a boiler member 316 so that the boiler member 316 is positioned above the concave step portion 314. The boiler member 316 is formed of a metal, with the lower frame portion 317 defining a boiler chamber 320 surrounded by cooling fins 319, and on top of the lower frame portion 317 is mounted a flat hollow boiler 321 composed of a thin metallic plate. From one end of the lower plate of the boiler 321 there project two metallic output pipes 322, 322 which open at the hollow portion of the boiler. At a half circumference on the front side of the boiler member 316 there is constituted a windshield 324 with retaining projections 325, 325 fitted in retaining holes 323, 323 formed in the bottom member 306. The windshield 324 is provided with through holes 326, 326 through which there project the output pipes 322, 322. The numeral 327 designates a candle supporting member made of a metal which is inserted and mounted in the boiler chamber 320. The candle supporting member 327 is provided at one end thereof with a handle 328 and is further provided with a candle mounting recess 329 in which is fitted a candle 330. The numeral 331 designates a rudder mounting hole formed in the perpendicular direction at the rear end of each of the supporting rods 303, 303. In the rudder mounting hole 331 is pivotably fitted a split pin-shaped pivot shaft 333 formed at one end of each of the rudder members 332, 332 so as to permit an angular displacement of the rudder member 322 with respect to the rudder mounting hole 331. And in the sides of the rudder members 332, 332 are formed output end holding holes 334, 334 in the direction of the plane, in which holes are inserted end portions 336, 336 of transparent flexible pipes 335, 335 so that the end portions 336, 336 open toward the rear, with the other ends of the transparent flexible pipes 335, 335 being connected through the intermediate holes 311, 311 to the output pipes 322, 322. The numeral 337 is a squirt-like water injector molded in the form of a missile, and the water injector 337 is provided at intermediate portions thereof with swollen lugs 340, 340 adapted to fit removably in concave portions 339, 339 which are formed in both supporting plates of a bracket 338, the bracket 338 being pivotably mounted on the rear part of the bottom member 306, thus permitting the water injector 337 to be supported in a tilted manner.

In operation of the steam pressure-propelled toy of this invention constructed as above, the candle 330 is fitted in the candle fitting recess 329 of the candle supporting member 327, then it is ignited and the candle supporting member 327 is set in the boiler chamber 320 to heat the lower surface of the boiler 321. Thereafter, the toy is floated on the water surface and water is injected from the end portion 336 of one transparent flexible pipe 335. In this case, the toy floats on the water surface stably by virtue of the two float tubes 309, 309 with submerged rudder members 332, 332. Thus in the same manner as in the previous embodiments a propulsive force is obtained by the steam pressure ejected from the end portion 336 of the transparent flexible pipe 335, whereby the toy advances in the direction of the rudder members 332, 332. In this case, the float tubes 309, 309 are submerged at nearly lower half portions thereof and are pivotably supported by the projecting shafts 310, 310 so that, coupled with the viscous resistance of water, they began to rotate in the direction of propulsion. This looks as if the toy run on the water surface by the rotary movement of the float tubes 309, 309. Furthermore, by pivoting the rudder members 332, 332 the holding direction for the end portions 336, 336 of the transparent flexible pipes 335, 335 can be changed, allowing the direction of steam ejection to become changed and the toy turned. By presetting the direction of the rudder members 332, 332 angularly, there can be obtained a desired turning radius.

Figure 11:
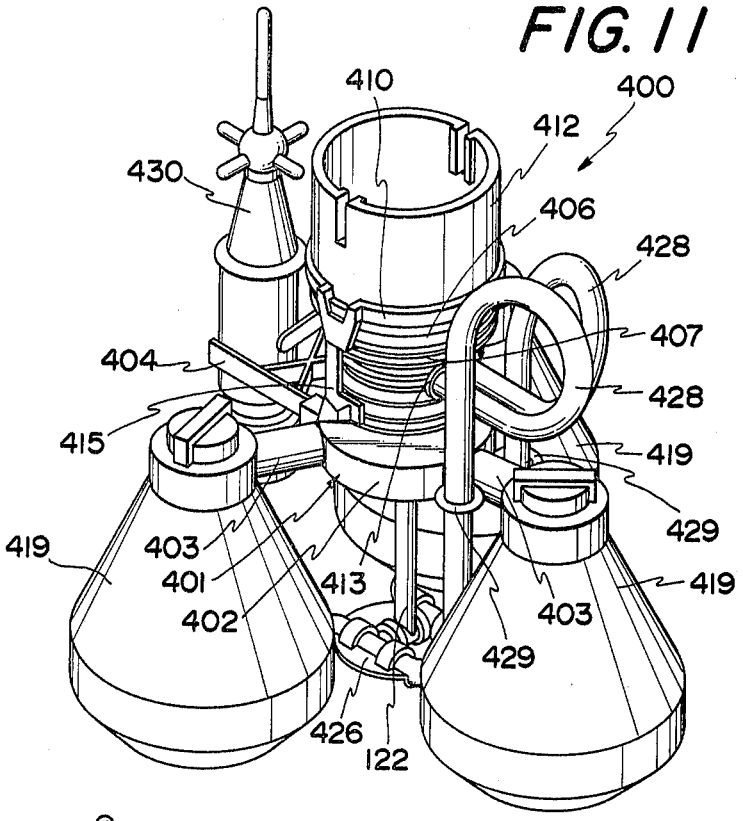
FIG. 11 is a perspective view of a steam pressure-propelled toy according to a fourth embodiment of the invention.
Figure 12:
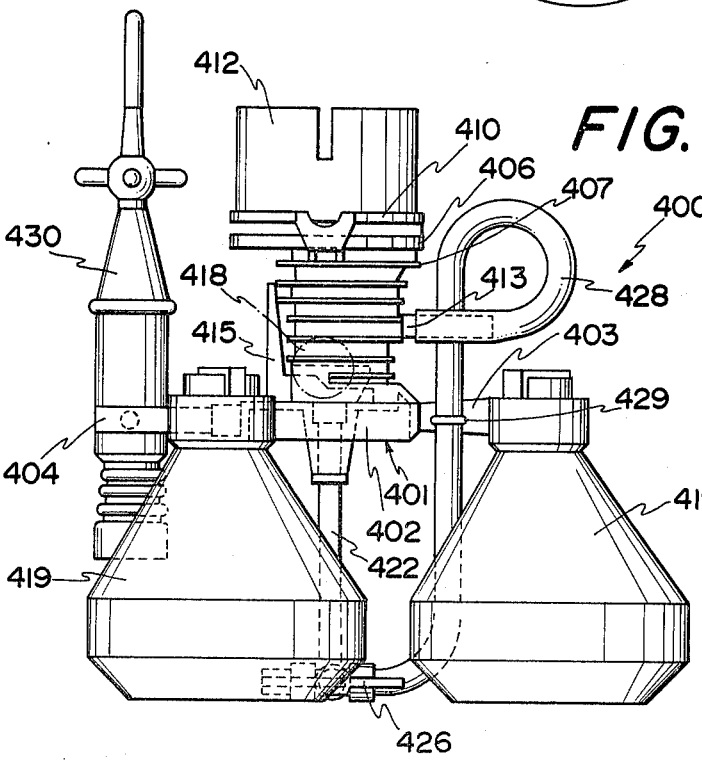
FIG. 12 is a side view thereof.
Figure 13:
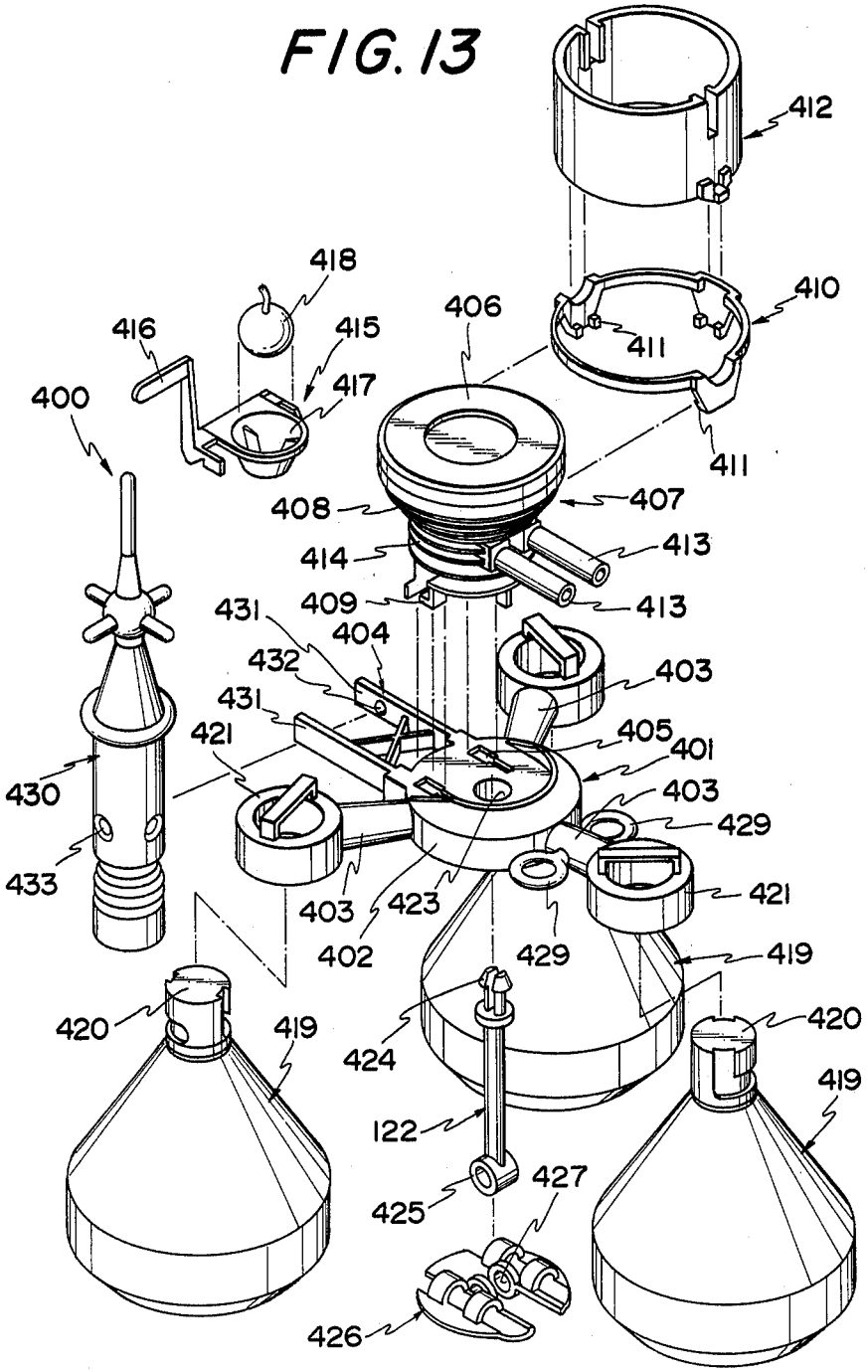
FIG. 13 is an exploded perspective view thereof.

Now a steam pressure-propelled toy 400 according to a fourth embodiment of this invention is dexcribed with reference to FIGS. 11 through 13. The reference numeral 401 is a base member consisting of a base plate 402, supporting arms 403, 403, 403 projecting in three ways at equiangles from the base plate 402, and a water injector bracket 404 mounted in a symmetrical position with one supporting arm 403, with the components being integrally formed of an aluminum die casting or heat-resisting synthetic resin. In the upper surface of the base plate 402 are formed engaging holes 405, 405 in which are fitted engaging projections 409, 409 formed at lower ends of a boiler supporting member 407, the boiler supporting member 407 carrying on the top thereof a boiler 406 and having a peripheral wall formed in the shape of cooling fins 408. In contact with the upper surface of the boiler 406 is an upper frame 410 from which there project retaining pawls 411, 411, 411 which are inserted between the cooling fins 408, 408 at the upper end of the boiler supporting member 407. And to the upper frame 410 is attached a cylindrical windshield 412. The boiler 406 is a flat hollow body formed of a thin metallic plate, from a lower plate portion of which there project two metallic output pipes 413, 413 which open in the hollow portion of the boiler, the output pipes 413, 413 extending from one side of the boiler supporting member 407. In the boiler supporting member 407 is formed a boiler chamber 414 at a position below the boiler 406, in which boiler chamber is inserted a candle supporting member 415 which is provided at one end thereof with a handle 416 and further provided with a candle fitting recess 417 for holding therein a candle 418. Numeral 419 designates a generally conical hollow float provided at the upper end thereof with a fitting projection 420 which is removably fitted in a hole formed at the tip end of each of the supporting arms 403, 403, 403. By virtue of the buoyancy of the floats 419, 419, 419 the toy floats stably on the water surface. Numeral 422 designates a nozzle supporting rod provided at one end thereof with a split pin-shaped engaging end 424 which is pivotably fitted in an axial hole 423 formed centrally in the base plate 402. At the other end of the nozzle supporting rod 422 is formed a pivot shaft 425 to which is attached a nozzle holding member 426 so as to be angularly displaceable in the latitudinal direction. In the nozzle holding member 426 are formed holding holes 427, 427 in which are fitted one ends of transparent flexible pipes 428, 428, with the other ends of the pipes 428, 428 communicating with the output pipes 413, 413 via ringed holders 429, 429 formed on the sides of one supporting arm 403. Numeral 430 designates a squirt-like water injector formed in the shape of a missile, which is provided in intermediate portions thereof with swollen projections 433, 433 capable of being removably fitted in concave portions 432, 432 formed at end portions of holding arms 431, 431 of the water injector bracket 404, whereby the water injector 430 is tilted at a desired angle in the latitudinal direction.

In operation of the steam pressure-propelled toy of this invention constructed as above, the candle 418 is fitted in the candle fitting recess 417 formed in the candle supporting member 415, then the candle supporting member 415 is set in the boiler chamber 414 and the candle 418 is ignited to heat the lower surface of the boiler 406. Thereafter, the toy is floated on the water surface and water is injected from the end portion of one transparent flexible pipe 428 by means of the water injector 430, whereby the same action as in the previous embodiments is attached. In this case, the angle of the nozzle holding member 426 can be changed in the latitudinal direction, so an angular displacement thereof can change the direction of the nozzle of the transparent flexible pipes 428, 428; that is, when the nozzle holding member 426 is made horizontal the toy runs on the water surface, and if it is made vertical the toy is endowed with a propulsive force in the perpendicular direction and consequently performs a humorous motion like hopping on the water surface, and further if the nozzle holding member 426 is slightly tilted there is obtained a propulsive force in the transverse direction which allows the toy to run slowly on the water surface while hopping.

As set forth hereinbefore, the steam pressure-propelled toy of this invention is a float body not assuming the form of the so-called ship, so can be manufactured new in shape and rich in imagination. Besides, the steam ejection end is formed of a flexible pipe so that the direction of steam ejection can be changed, resulting in that the toy can undergo humorous motions, including vertical, horizontal and turning motions. Furthermore, the propulsion mechanism is formed of a transparent body permitting observation of the state of action, so the toy in question is useful as a scientific toy. The toy of this invention is also useful as an assembly toy because it can be assembled simply by fitting its components.

Althrough the invention has been described in its four preferred embodiments with a certain degree of particularity, it is apparent that many widely different embodiments of the invention may be made without departing from the spirit and scope thereof, so it is to be understood that the invention is not limited to the specific embodiments thereof except as defined in the appended claims.

What is claimed is:

1. A steam toy comprising a base structure having a front and a rear, float means comprising a pair of spaced apart float members for floatably supporting said base structure on a body of water, said base structure being disposed to overlie said spaced apart float members, first mounting means mounting said float means on said base structure, a boiler means, second mounting means mounting said boiler means on said base structure above the level of said body of water, said second mounting means comprising a windshield detachably mounted on said base structure, said boiler means being mounted on an upper portion of said windshield, a heat source disposed on said base structure in a position underlying said boiler means, a pair of pipes leading externally from said boiler means, each of said pipes having one end connected to said boiler means above the level of said body of water and each having its other end disposed below the level of said body of water when the float means floatably supports said base structure on said body of water, said pair of pipes extending from said boiler means forwardly and then curving rearwardly in U-shaped fashion to pass between said two float members and extend toward the rear of said base structure, and third mounting means mounting said other end portions of said pipes below the level of said body of water to thereby provide for propulsion of said steam toy as fluid exits from said pipes, said third mounting means comprising a first arm pivotably mounted from the rear of said base structure and extending in cantilever fashion beyond the rear of said base structure, and a second arm connected to said first arm and extending downwardly to support said other end portions of said pipes.

2. A steam toy according to claim 1 wherein said windshield is provided with openings through which said pipes pass.

3. A steam toy according to claim 1 wherein said windshield has a semi-cylindrical portion and a semi-spherical portion, said boiler means comprising a disk-like body mounted on the inner walls of said semi-cylindrical portion.

4. A steam toy comprising a base structure, float means for floatably supporting said base structure on a body of water, said float means comprising an endless circular float member having a central opening, first mounting means mounting said float means on said base structure, said first mounting means comprising leg members mounting said base structure at said central opening so that said base structure is disposed at a higher elevation than said circular float member, said base structure comprising a base plate integrally formed with said leg members, a boiler means, second mounting means mounting said boiler means on said base structure above the level of said body of water, said second mounting means comprising a windshield detachably mounted on said base plate, said boiler means being mounted on an upper portion of said windshield, a pair of pipes leading externally from said boiler means, each of said pipes having one end connected to said boiler means above the level of said body of water and each having its other end disposed below the level of said body of water when the float means floatably supports said base structure on said body of water, and third mounting means mounting said other end portions of said pipes below the level of said body of water to thereby provide for propulsion of said steam toy as fluid exits from said pipes, said third mounting means comprising openings on said leg members rotatably supporting said other end portions of said pipes.

5. A steam toy comprising a base structure, float means for floatably supporting said base structure on a body of water, said float means comprising a pair of spaced general cylindrical float members having parallel axes, said base structure comprising a longitudinally extending central support member passing between said two float members and parallel to the axes of said float members, arms integrally formed on the ends of said central support members and extending perpendicular to said central support member, first mounting means mounting said float means on said base structure, said first mounting means being disposed at the end portions of said arms for rotatably supporting said float members, said base structure further comprising a base member detachably mounted on said central support member, a boiler means, second mounting means mounting said boiler means on said base structure above the level of said body of water, said second mounting means detachably mounting said boiler means on said base structure, a pair of pipes leading externally from said boiler means, each of said pipes having one end connected to said boiler means above the level of said body of water and each having its other end disposed below the level of said body of water when the float means floatably supports said base structure on said body of water, and third mounting means mounting said other end portions of said pipes below the level of said body of water to thereby provide for propulsion of said steam toy as fluid exits from said pipes.

6. A steam toy according to claim 5 wherein said third mounting means comprises rudders pivotably mounted on said arms, and mounting elements on said rudders for mounting thereon said end portions of said pipes.

7. A steam toy according to claim 5 wherein said central support member has openings through which said pipes pass.

8. A steam toy according to claim 5 wherein said boiler means comprises a lower frame portion defining a boiler chamber surrounded by fins, said second mounting means comprising projections on said lower frame portion detachably mounted on said base structure, means for supporting a heat source mounted in said boiler chamber, and further comprising a windshield at least partially disposed about said boiler chamber.

9. A steam toy comprising a base structure, float means for floatably supporting said base structure on a body of water, said float means comprising a plurality of float members each concentrically disposed about a vertical axis, each of said float members having an upper projection, said base structure having a plurality of radial arms, first mounting means mounting said float means on said base structure, said first mounting means comprising openings in the radial end portions of said arms in which said projections on said float members are received, said base structure having a central base plate from which said radial arms extend, a boiler means, second mounting means mounting said boiler means on said base structure above the level of said body of water, a pair of pipes leading externally from said boiler means, each of said pipes having one end connected to said boiler means above the level of said body of water and each having its other end disposed below the level of said body of water when the float means floatably supports said base structure on said body of water, and third mounting means mounting said other end portions of said pipes below the level of said body of water to thereby provide for propulsion of said steam toy as fluid exits from said pipes, said third mounting means comprising an elongated rod member extending downwardly from said central base plate, and mounting elements on said rod member for mounting said other end portions of said pipes.

10. A steam toy according to claim 9 wherein said rod member is rotatably mounted on said central base plate.

11. A steam toy according to claim 9 wherein one of said radial arms has support elements for supporting said pipes.

12. A steam toy according to claim 9 wherein said boiler means comprises a lower frame portion defining a boiler chamber surrounded by fins, said second mounting means comprising projections on said lower frame portion detachably mounted on said base structure, said boiler means further comprising a generally hollow body formed of metallic plates mounted on said lower frame structure, and a windshield mounted above said hollow body.

* * * * *